United States Patent [19]

Bernardi

[11] 4,045,321

[45] Aug. 30, 1977

[54] METHOD AND APPARATUS FOR PLATING THE POSTS OF A SEMICONDUCTOR CHIP HEADER

[75] Inventor: Carl E. Bernardi, San Jose, Calif.

[73] Assignee: National Semiconductor Corporation, Santa Clara, Calif.

[21] Appl. No.: 623,323

[22] Filed: Oct. 17, 1975

[51] Int. Cl.[2] ..... C25D 17/28; C25D 17/22; C25D 5/02

[52] U.S. Cl. ..... 204/202; 204/224 R

[58] Field of Search ..... 204/198-203, 204/224 R, 15

[56] References Cited

U.S. PATENT DOCUMENTS

| | | | |
|---|---|---|---|
| 2,749,300 | 6/1956 | Thomas | 204/200 |
| 3,123,543 | 3/1964 | Chapman, Jr. et al. | 204/203 |
| 3,409,531 | 11/1968 | Ryerson et al. | 204/202 |
| 3,878,062 | 4/1975 | Grimaldi | 204/202 |
| 3,897,323 | 7/1975 | Schlotthauer | 204/198 |
| 3,951,772 | 4/1976 | Bick et al. | 204/224 R |

*Primary Examiner*—T. M. Tufariello
*Attorney, Agent, or Firm*—Gail W. Woodward; Willis E. Higgins

[57] ABSTRACT

A method and apparatus for plating the posts of a semiconductor chip header is described. A means is provided for orientating the headers and feeding them in single file to a predetermined position in the apparatus. A transporting means is provided for transporting the headers from the feeding means over a plating bath such that the posts of the header are immersed in the bath. Attached to the transporting means is a plurality of clamping assemblies. Each of the clamping assemblies includes a knife-like member for electrically insulating the thru-leads of the header from its envelope lead and means for clamping the thru-leads of the header to the knife-like member. The clamping means of the clamping assemblies also include means for coupling a source of potential between the plating bath and the thru-leads clamped therein.

8 Claims, 10 Drawing Figures

METHOD AND APPARATUS FOR PLATING THE POSTS OF A SEMICONDUCTOR CHIP HEADER

BACKGROUND OF THE INVENTION

The present invention is related to a method and apparatus for plating semiconductor chip headers in general and, in particular, to a method and apparatus for plating header posts.

A typical semiconductor chip header includes a body member. The body member comprises an insulating material encased in a metallic envelope for forming a chip receiving surface on the top thereof. Extending from the bottom of the body member is a plurality of leads. Normally one of the leads, called for convenience an envelope lead, is electrically connected to the envelope for providing an electrical connection to a chip bonded to the top of the envelope. The others of said plurality of leads are disposed to pass through said header body and are electrically insulated from said envelope for forming posts on the top thereof. The posts are typically located outwardly of the chip receiving area and are provided to be connected, in the course of fabricating a solid state device, to selected parts of the chip as by thin wires or the like.

In the process of fabricating semiconductor devices, it is frequently necessary to plate the posts. Heretofore, this has been done by inserting the headers in an inverted position in individual holes in the bottom of a supporting container or belt such that the posts of the headers and a portion of the body project downwardly therethrough. The posts and the portion of the header body projecting through the holes are then immersed in a plating solution.

For the plating process to occur, it is necessary to provide an electrical potential between the posts and the plating solution such that a current will flow therebetween. For convenience and because there has been no prior known way to simply and economically make an electrical contact between the posts alone and the bath, it has been the practice to place one electrode in the bath and another in electrical contact with the header leads. Because of the number of leads and the lack of any prior known practical way to separate them economically, it has been the practice to make the electrical contact with the leads using a fluid or powdered electrolyte. When doing this, however, both the thru-leads and the envelope lead are electrically connected. This results in plating not only the posts but also that portion of the header extending with the posts through the supporting belt or container.

Frequently, for some applications, only the posts require plating with a precious metal. In other applications, the header chip receiving area may be plated with one type of precious metal and the posts with another type of precious metal. In either case, if the precious metal required for the posts can be restricted to the posts in the plating process, it is obvious that a considerable savings in the cost and use of precious metals is possible.

SUMMARY OF THE INVENTION

In view of the foregoing, a principal object of the present invention is a method and apparatus for selectively plating the posts of a semiconductor chip header.

Among the features of the present invention in accordance with the above object is a means for orientating the headers and feeding them in single file to a predetermined position in the apparatus. At the end of the feeding means there is provided a header transporting means. The transporting means is provided for transporting the headers from the end of the feeding means through a plating bath with the posts immersed in the bath. The transporting means comprises a plurality of clamping assemblies. Each of the clamping assemblies is associated with means for electrically insulating the thru-leads from the envelope lead so that only the thru-leads are clamped and connected to a source of potential. The source of potential is also connected to the bath such that, when the posts are immersed in the bath, a current will flow through the thru-leads and posts only and not through any other part of the header.

For continuous operation, the plating bath is contained in a container having end walls over which the bath is caused to flow continuously. The height of the end walls and the amount of flow over the end walls is chosen such that the posts of a header carried in one of the clamping assemblies will clear the end walls while being immersed in the bath.

In addition, means are also provided for automatically releasing each header from the clamping means after its posts are plated and rinsed, allowing the header to fall in a storage bin.

DESCRIPTION OF THE DRAWINGS

The above and other objects, features and advantages of the present invention will become apparent from the following detailed description of the accompanying drawings in which.

DETAILED DESCRIPTION

Figures 1, 2, 3:
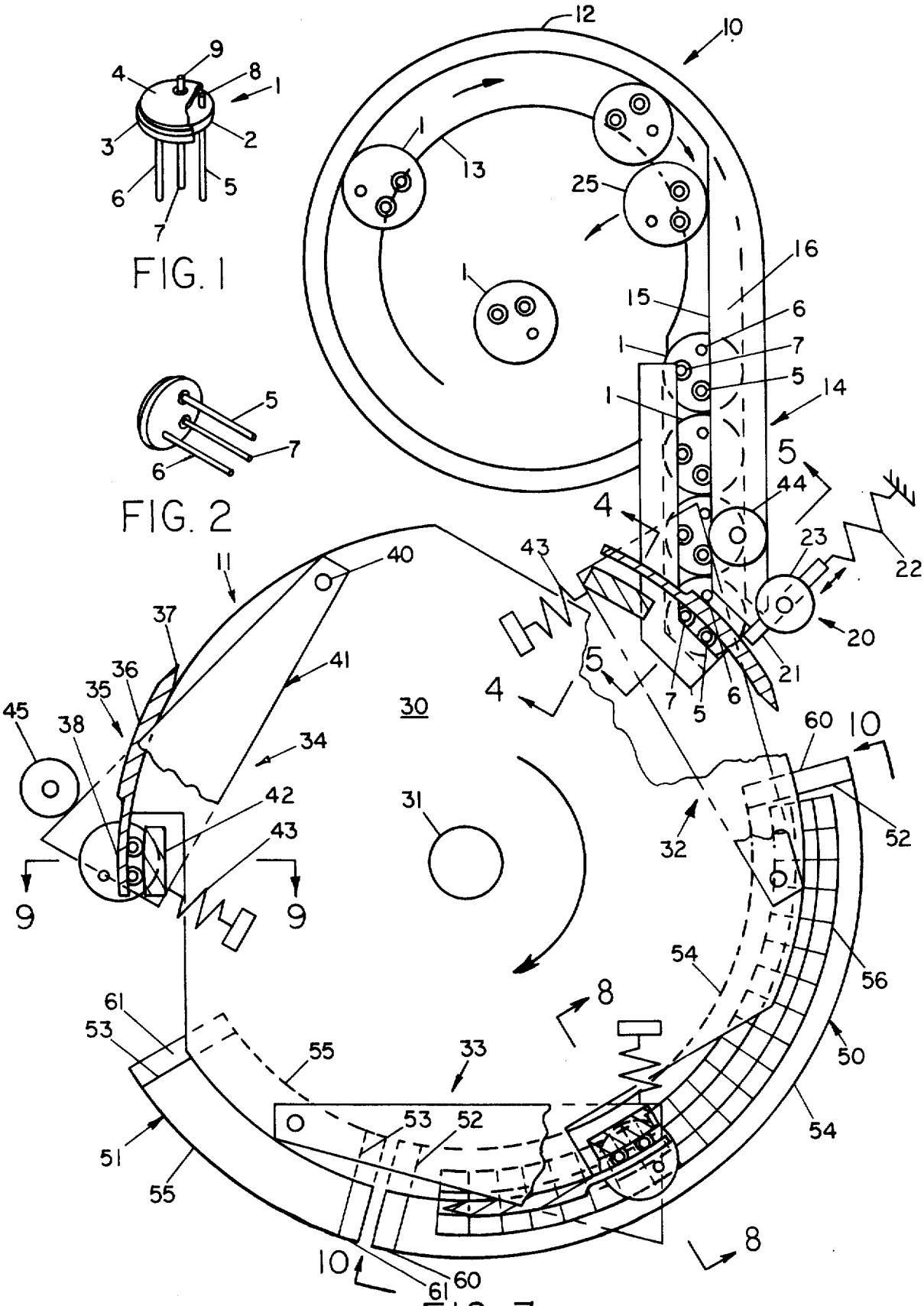
FIG. 1 is a top perspective view showing the posts of a typical header which can be plated with the method and apparatus of the present invention.
FIG. 2 is a bottom perspective view of the envelope and thru-leads of the header of FIG. 1.
FIG. 3 is a plan view of an apparatus according to the present invention.

Referring to FIGS. 1 and 2, there is shown a header 1. Header 1 comprises a body member of insulating material 2 encapsulated in a metallic envelope 3. On the top of header 1 there is a generally flat surface forming semiconductor chip receiving surface 4 on which is bonded a semiconductor chip (not shown) during the fabrication of a semiconductor device using the header 1. Extending from the bottom of header 1 are three leads: 5, 6 and 7. Lead 6 is attached directly to the metallic envelope 2. Leads 5 and 7 are insulated from envelope 2 and pass through the material 2 of header 1 for forming on the top thereof, respectively, a pair of posts 8 and 9. In the fabrication of a semiconductor device using the header 1, the posts 8 and 9 are employed for making an electrical connection by means of thin wires or the like (not shown) attached thereto and to selected parts of a chip bonded on the surface 4.

As pointed out hereinabove, it is frequently necessary to plate the posts of a header for providing good long-term conductivity between the posts and a wire connected thereto. Header 1 is representative of the types of headers having posts which can be plated by means of the present invention. Thus, while the posts of other types of headers may also be plated, it is believed sufficient for purposes of describing the present invention to limit the description to the plating of headers represented by header 1.

Referring to the drawings and presently, in particular, to FIG. 3, there is provided in accordance with the present invention, a conventional header bin or hopper assembly 10. Hopper 10 is provided for orientating and feeding a plurality of headers 1 to a header transporting assembly 11.

Figure 5:
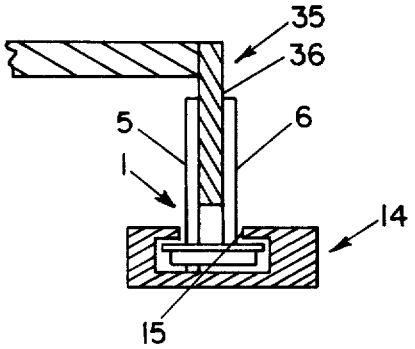
FIG. 5 is a cross-sectional view taken along lines 5—5 of FIG. 3.

In hopper 10 there is provided a dish-like annular container 12. Adjacent to an outside wall in the interior of container 12 there is provided an upwardly directed spiral track 13. At an upper edge of the container wall and connected to the discharge end of a straight portion of the track 13, there is provided a header feed channel 14. Channel 14 extends from the hopper 10 to a predetermined position in the apparatus and is provided with an open end adjacent to an edge of the transporting assembly 11. As shown more clearly in FIG. 5, channel 14 is hollow and has a generally rectangular cross-section with a slot 15 extending along its entire length. At the hopper end of channel 14, an upper outside portion 16 of the channel is provided to overlay the straight portion of the track 13. Alternatively, portion 16 may be replaced by a rigid wire or the like and channel 14 provided with coextensive upper members at its hopper end.

At the open end of channel 14, there is provided an escapement mechanism 20. Mechanism 20 is provided with a gate member 21, a spring 22, or the like, and a roller 23.

In operation, by a motor and other means not shown, hopper 10 is caused to vibrate and execute a motion in a well known manner such that headers 1 are transported with their leads 5, 6 and 7 in an upright vertical position from its lower central portion upwardly along the track 13. When a header reaches the straight portion of the track 13 along the upper interior edge of the hopper, it encounters the channel portion 16 or a wire as the case may be. Because of the asymmetrical location of the leads 5, 6 and 7, only those headers having an orientation such that the leads 5 and 6 lie in a plane adjacent to the edge of the portion 16 of the channel 14 will remain on the track 13 and be discharged into the slot 15 of channel 14. The other headers, such as that represented by a header 25, will topple from the track and into the bottom of the hopper 10, as shown by the arrow.

Figure 6:
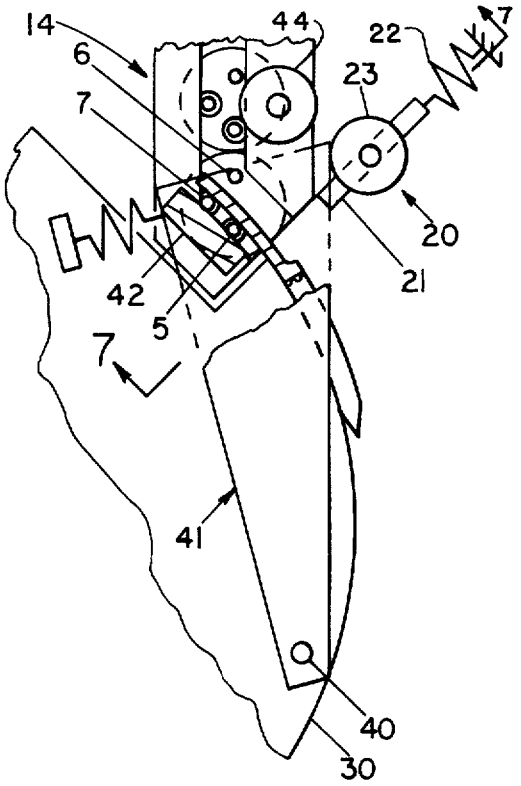
FIG. 6 is a partial plan view of one of the clamping assemblies of the apparatus of FIG. 3.
Figure 7:
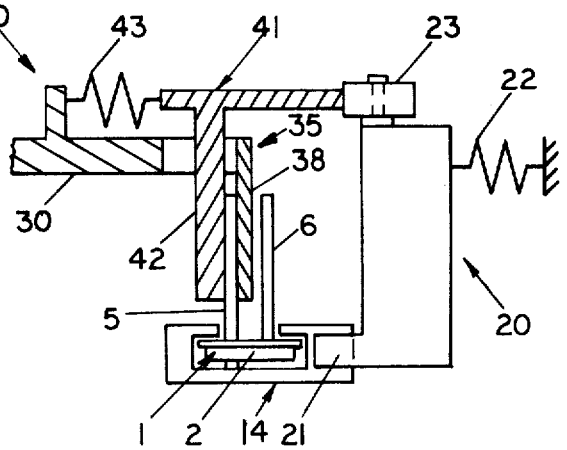
FIG. 7 is a cross-sectional view taken along lines 7—7 of FIG. 6.

To prevent the headers from being discharged from the open end of channel 14, the escapement mechanism 20 is biased by means of the spring 22 in such a manner that the gate 21 normally covers the open end. The roller 23, as will be apparent in reference to FIGS. 6 and 7, is provided for sliding the gate 21 from the open end of the channel and against the force of the spring 22 when contacted by the transporting assembly 11.

Transporting assembly 11 is provided with a movable member 30. Member 30 is coupled for rotation by means of a shaft 31 to a motor or the like (not shown). Mounted in a spaced relationship about the periphery of member 30 there is provided a plurality of identical header clamping assemblies 32, 33 and 34 for picking-off the headers from the discharge end of the channel 14.

Each of assemblies 32, 33 and 34 is provided with a knife-like member 35 having a leading section 36 with a relatively narrow leading edge 37 and a trailing section 38. Section 38 is provided with a substantially narrower cross-section than the leading section 36.

As shown more clearly in FIG. 3, pivotably connected to member 30 by means of a pin 40 or the like is a pivotable clamping mechanism 41 comprising a clamping member 42 depending downwardly therefrom. Clamping mechanism 41 is coupled to a spring 43 or the like for biasing the member 42 normally against the interior of the trailing section 38 of the knife-like member 35.

For opening the mechanism 41 against the spring 43, there is further provided a pair of rollers 44 and 45. Roller 44 is located at the discharge end of channel 14 and roller 45 is located at a suitable position for releasing the headers as will be further described.

Located beneath a portion of the path of travel of the knife-like member 35, there is provided a container 50 and a container 51. Containers 50 and 51 each have a pair of end walls 52 and 53 and a pair of side walls 54 and 55, respectively. The end walls of the containers 50 and 51 are provided to be somewhat lower than their respective side walls 54 and 55. In the interior of container 50, there is further provided a metallic electrode in the form of a screen or wire 56. Coupled between electrode 56 and clamping member 42 in any suitable manner is a source of potential. In a typical plating operation, the member 42 serves as the cathode and the screen or wire 56 serves as the anode. For example, a battery B or other d.c. current source may be coupled between the electrode 56 and the clamping members 42 by means of a contact 59 in sliding contact with the shaft 31. In that case, electrical continuity is provided between the shaft 31 and clamping members 42.

In operation, container 50 is filled with a plating solution. Container 51 is filled with a rinsing solution. The rinsing solution is provided for rinsing the headers after their immersion in the plating solution as described below. Headers are placed in hopper 10 and are fed to the end of the channel 14. At the end of channel 14, the leads 5, 6 and 7, as described previously, are orientated in such a manner that the knife-like member 35 passes between the lead 6 and the leads 5 and 7. Lead 6, it will be recalled, is the lead connected to the envelope 2. Leads 5 and 7 are the thru-leads which pass through the header for forming the posts 8 and 9 on the top thereof.

As the leading section 36 of the knife-like member 35 passes between lead 6 and leads 5 and 7, the leads are separated. The separation of the leads is necessary in the event they are in electrical contact so that, as will be described, only the thru-leads 5 and 7 will be coupled to the aforementioned source of potential.

Figure 4:
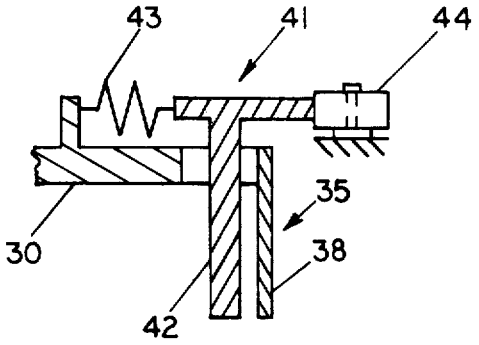
FIG. 4 is a cross-sectional view taken along lines 4—4 of FIG. 3.

As the lead 6 and the leads 5 and 7 are separated by the leading section 36 of the knife-like member 35 as shown in the assembly 32 of FIG. 3, the leading edge of clamping mechanism 41 comes into contact with the roller 44. As shown more clearly in FIG. 4, contacting the roller 44 causes the mechanism 41 to be pivoted inwardly against the force of the spring 43. The inward movement of the mechanism 41 causes the clamping member 42 to be moved away from the interior surface of the trailing section 38 of the knife-like member 35 to thereby ready the mechanism 41 for receiving the thru-leads 5 and 7.

Referring to FIG. 6, as the mechanism 41 leaves contact with the roller 44, member 42 closes upon the thru-leads 5 and 7 and substantially simultaneously therewith, the leading edge of mechanism 41 engages roller 23. As shown more clearly in FIG. 7, the contact between mechanism 41 and roller 23 causes the roller to slide the gate 21 against the force of the spring 22 to thereby remove the gate 21 from the open end of the channel 14. Opening the channel 14 permits the assembly 30 to remove a header therefrom upon further rotation in a clockwise direction.

It may be noted at this point that, due to the reduced cross-section of the trailing section 38 of the knife-like member 35, the lead 6 is clearly not in contact with the member 35. Moreover, since the header body is somewhat below the lower edge of the member 35, there is also no contact between the member 35 and the metallic envelope 3 of the header. It may also be noted at this point that, in lieu of utilizing a knife-like member 35 having a trailing section of reduced cross-section, an insulating material or film could be employed on the exterior surface of the member 35 for insulating the lead 6. As still a further alternative, one could fabricate the member 35 entirely of insulating material.

Once the thru-leads 5 and 7 are securely clamped against member 35 and the end of channel 14 is opened, further rotation of the assembly 11 in a clockwise direction removes the header from the channel and carries it over the surface of the plating solution to the container 50.

Figure 8:
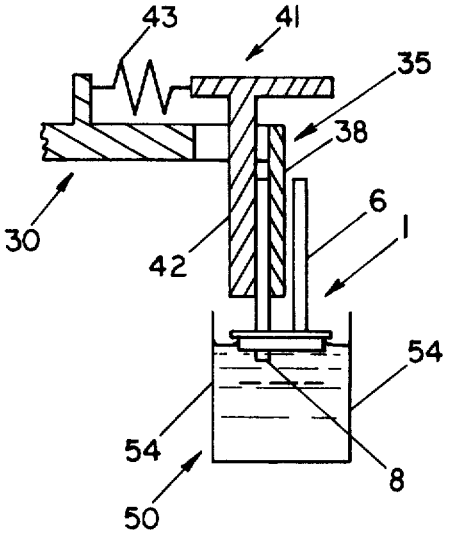
FIG. 8 is a cross-sectional view taken along lines 8—8 of FIG. 3.
Figure 10:
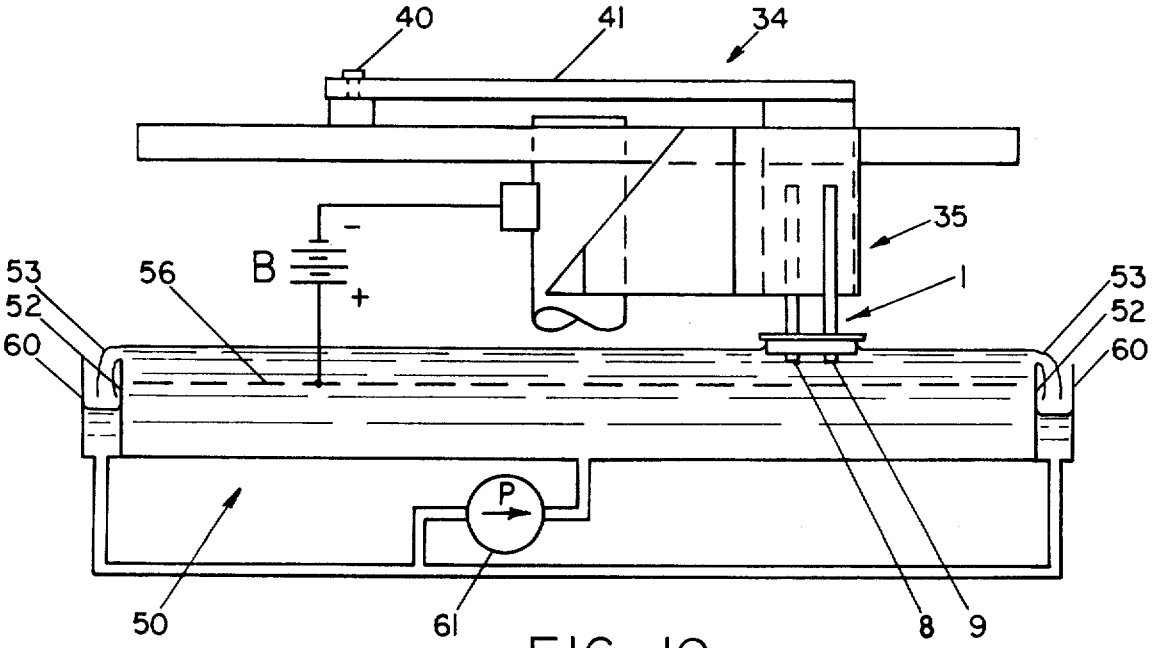
FIG. 10 is a diagrammatic elevation view taken in the direction of lines 10—10 of FIG. 3.

Referring to FIGS. 8 and 10, there is provided adjacent to end walls 52 of container 50, a further containing means 60. Means 60 is connected to container 50 by a pump 61. Pump 61 is provided for continuously pumping plating solution from the containing means 60 into the container 50 such that there is a continuous predetermined flow of plating solution over the end walls 52, as shown at 53. As will be appreciated, the amount of overflow, the height of end walls 52 and the distance of the posts 8 and 9 relative to the end walls 52 are controlled such that the posts will clear the end walls while being immersed in the plating solution. It may be noted that the surface tension characteristics of the plating solution also tend to insure immersion of the posts 8 and 9 by causing the solution to rise above the posts.

Since, as previously described, a source of potential is coupled between the thru-leads 5 and 7 and the screen or wire 56 when clamping member 42 engages the thru-leads, a current will flow in the solution and through the posts 8 and 9 as soon as the posts enter the solution. As is well understood by those skilled in the art, this current flow will effect plating of the posts so long as a suitable plating solution is employed in the container 50. Since lead 6 and envelope 3 are at all times insulated from the member 35 while the header is being transported through the bath, as shown clearly in FIG. 8, it is apparent that only the posts 8 and 9 will be plated even though parts of the header body may be immersed in the solution.

The container 51 is constructed in a fashion similar to container 50. It includes pump means and the like (not shown) for causing the rinsing solution to overflow the end walls 53 as well as an additional containing means 61 for receiving an overflow of rinsing solution caused by the pump means overflowing the end walls 53 in the manner described above with respect to container 50.

Figure 9:
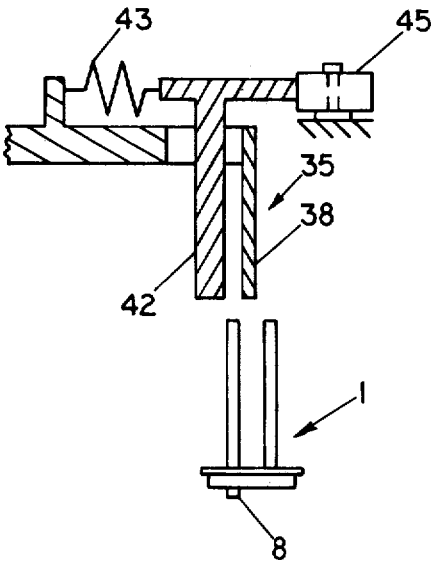
FIG. 9 is a cross-sectional view taken along lines 9—9 of FIG. 3.

Referring to the assembly 34 in FIG. 3 and to FIG. 9, beyond the container 51 in the direction of rotation of assembly 11, the leading edge of mechanism 41 contacts the roller 45 causing the mechanism 41 to pivot inwardly against the force of spring 43. This pivoting of member 41 causes the clamping member 42 to release the header 1. Upon release, the header 1 is free to drop away from the member 42 and into a receptacle (not shown) for further processing.

It is apparent from the foregoing that, while a specific embodiment is described, numerous changes and modifications may be made thereto within the spirit and scope of the present invention. For example, while only three assemblies 32, 33 and 34 are shown, the assemblies, in practice, can be made quite small and a large number of such assemblies spaced about the perphery of the member 30. It is also apparent that the transporting member 30 to which each of the clamping assemblies is attached need not be circular. It could, for example, comprise a linear means, such as a flexible belt, which is supported over rectangularly shaped, rather than arcuately shaped, plating and rinsing solution containers. Moreover, the specific means for coupling the source of potential between the clamping assemblies and plating bath is clearly a matter of design choice which may be adapted according to the requirement of the equipment.

It is, therefore, intended that the scope of the invention should not be limited to the embodiment described but, rather, be determined by reference to the claims hereinafter provided and their equivalents.

What is claimed is:

1. An apparatus for plating the posts of a semiconductor chip header having at least one envelope lead electrically connected to a metallic envelope enclosing said header and a predetermined number of thru-leads which are insulated from and pass through said envelope for forming posts on the top thereof comprising:

means for feeding a plurality of said headers in single file to a predetermined position in said apparatus, said means for feeding including means for providing a predetermined orientation of said thru-leads at said predetermined position;

means for transporting said headers from said predetermined position over the surface of a plating bath for immersing said posts in said bath;

means for separating and electrically insulating said thru-leads from said envelope lead including means associated with said transporting means for clamping and holding said header; and means for coupling a source of potential between said thru-leads and said bath while said posts are immersed in said bath for selectively plating said posts.

2. An apparatus for plating the posts of a semiconductor chip header having at least one envelope lead electrically connected to a metallic envelope enclosing said header and a predetermined number of thru-leads which are insulated from and pass through said envelope for forming posts on the top thereof comprising:

means for transporting a header over the surface of a plating bath such that said posts are immersed in said bath;

means for electrically insulating said thru-leads from said envelope lead;

said insulating means being attached to an edge of said transporting means and including means for separating said thru-leads from said envelope lead;

said separating means comprising a knife-like plate movable member having a leading section with a relatively narrow leading edge and a trailing section extending rearwardly of said leading section relative to the direction of movement of said movable member for passing between said thru-leads and said envelope lead whereby said thru-leads and said envelope lead are positioned on opposite sides of said knife-like plate member; and means for coupling a source of potential between said thru-leads and said bath while said posts are immersed in said bath for selectively plating said posts.

3. An apparatus according to claim 2 wherein said means for coupling a source of potential between said thru-leads and said bath comprises means for clamping said thru-leads to said trailing section of said knife-like plate member, said clamping means serving also to support said headers while said transporting means transports said headers over said bath surface.

4. An apparatus according to claim 3 wherein said trailing section of said knife-like plate member has a narrower cross-section than the corresponding cross-section of said leading section such that said envelope lead is spaced from said trailing section when said thru-leads are clamped to said trailing section by said clamping means.

5. An apparatus according to claim 4 wherein said clamping means comprises:

a clamping member; and means for resiliently closing said clamping member against said trailing section of said knife-like member and further comprising;

first means for opening said clamping member at said discharge opening of said track means whereby the thru-leads of a header at said discharge opening of said track means are clamped to said trailing section of said knife-like member; and second means for opening said clamping members for releasing said header therefrom after said transporting means has transported said header over said plating bath.

6. An apparatus according to claim 5 further comprising:

means for containing said plating bath disposed adjacent to an edge of said transporting means, said containing means having a pair of end walls;

means for causing said plating bath to continuously overflow said end walls, said end walls having an upper extremity such that the posts of a header being transported by said transporting means in said clamping means will clear said end walls while being at least partially immersed in said overflow; and means forming an electrode in said containing means for coupling to said clamping means.

7. An apparatus according to claim 6 further comprising: means forming a drag-out bath for rinsing headers exiting from said plating bath.

8. An apparatus according to claim 7 wherein said transporting means comprises a rotatable member, said clamping means comprises a plurality of clamping assemblies spaced at predetermined intervals about the periphery of said rotatable member and each of said clamping assemblies comprises said separating means and said clamping member.

* * * * *